US005635792A

United States Patent [19]

Jung et al.

[11] Patent Number: 5,635,792

[45] Date of Patent: Jun. 3, 1997

[54] IN-LINE TYPE ELECTRON GUN FOR A COLOR PICTURE TUBE

[75] Inventors: Sung-youb Jung, Kyungsangbuk-do, Rep. of Korea; Francis J. Campbell, Yardley, Pa.

[73] Assignee: Orion Electric Co. Ltd., Gumi, Rep. of Korea

[21] Appl. No.: 366,673

[22] Filed: Dec. 30, 1994

[51] Int. Cl.[6] ..... H01J 29/51; H01J 29/50

[52] U.S. Cl. ..... 313/412; 313/414; 313/460

[58] Field of Search ..... 313/412, 413, 313/414, 449, 447–446, 448, 460

[56] References Cited

U.S. PATENT DOCUMENTS

| | | | |
|---|---|---|---|
| 4,583,024 | 4/1986 | Chen | 313/414 |
| 4,898,556 | 2/1990 | Day | 313/414 X |
| 5,202,604 | 4/1993 | Kweon | 313/412 X |
| 5,300,854 | 4/1994 | Kweon | 313/412 X |
| 5,424,604 | 6/1995 | Hyun | 313/412 X |

*Primary Examiner*—Sandra L. O'Shea
*Assistant Examiner*—Jay M. Patidar
*Attorney, Agent, or Firm*—Morgan & Finnegan, L.L.P.

[57] ABSTRACT

In a conventional construction of an electron gun with quadrupole lenses, a grid part with elongated apertures all arranged in the same direction cannot be easily secured to alignment mandrels of circular cross section. As a result, grid movement during assembly can cause a misalignment that deteriorates the tube resolution. The present invention includes arranging circular and elongated apertures in the same grid part, and also alternately arranging circular and elongated apertures in adjacent grid parts, so as to secure the grid parts to the mandrels and automatically maintain the alignment during gun assembly. The aperture combinations described herein produce electron lens astigmatism of approximately the same strength and sign for each beam of an in-line gun.

10 Claims, 5 Drawing Sheets

IN-LINE TYPE ELECTRON GUN FOR A COLOR PICTURE TUBE

FIELD OF THE INVENTION

The present invention relates to a color picture tube, and particularly to an electron gun thereof having a plurality of in-line type grids to form quadrupole lenses.

BACKGROUND OF THE INVENTION

A cathode ray picture tube is an apparatus for displaying images which forms an electron beam by focusing and accelerating electrons generated from a cathode, and makes the beam selectively scan a phosphor screen by deflection means.

An electron gun is used to form the electron beam. An electrostatic type gun is typically used which focuses the beam by electrostatic lenses formed by the potential difference between a plurality of grids to each of which different voltages are applied.

At each of the grids of the electron gun, there are formed beam passing holes through which electron beams to be controlled are passed. In a Black and White (B/W) gun, circular holes and accordingly circular lenses are generally adopted.

As for a gun for a color picture tube having three beam passing holes, a large amount of spherical aberration and astigmatism occurs, as boundary conditions for each of the R, G, B beams are different from each other. A main lens of a high brightness color picture tube, for example, is formed in a large diameter lens in which all three beams pass through a large common aperture to reduce the spherical aberration. Because of its shape, the main lens of this type has a built-in astigmatism which deforms the landing spot and deteriorates the resolution of the picture tube.

The astigmatism occurs when the horizontal component and the vertical component of the electron beam, namely the horizontal beam and the vertical beam, are respectively focused in different intensities. A positive astigmatism means a stronger focusing by the vertical beam than the horizontal beam, and a negative astigmatism means the contrary.

The astigmatism can be compensated by fabricating at least one quadrupole lens having an opposite astigmatism to the electron gun main lens. Comparing with the circular lens which focuses all beams to a point, the quadrupole lens is used as a generic name of a non rotational-symmetric lens which focuses the electron beam differently in two perpendicular planes.

Meanwhile, means for deflecting, such as a deflection yoke, is used for scanning the electron beam. A self convergence type yoke forms a yoke field having a positive astigmatism which causes the deflection defocusing and distort distorts the shape of beam spots. In other words, the vertical component of the electron beam, namely the vertical beam, is overfocused by the positive astigmatism of the deflection yoke. This overfocusing can be compensated by adopting a dynamic focusing gun. In the gun, intensities of the main lens and the quadrupole lens are in synchronism with the deflection, to focus and reform the beam spot to be circular again.

Referring to FIG. 1, a typical quadrupole lens is formed by providing vertically or horizontally elongated electron beam passing holes Hv, Hh to each of two adjacent grids E1', E2'. Each of holes Hv, Hh of two grids E1', E2' are vertically or horizontally formed in parallel. When a vertically elongated hole is formed on a high potential lens or when a horizontally elongated hole is formed on a low potential lens, the quadrupole lens formed therebetween has a positive astigmatism. Assuming the E1' designates a high potential grid, and E2' a low potential grid, for example, a quadrupole lens of positive astigmatism is formed between two grids E1', E2'. Meanwhile, flanges f are formed to control the shape of the electric field, at outer edge portions of holes Hv, Hh.

These grids E1', E2' are assembled to an electron gun by being secured to glass rods, which are commonly called bead glasses, through heat melting. During the assembly, each of grids E1', E2' are temporarily secured by the insertion of mandrels of a jig to each of beam passing holes Hv, Hh, and then assembled with bead glasses.

Referring to FIG. 2, three mandrels P are fabricated on a jig(not shown), and each of component grids E1', E2' are sequentially inserted thereon. As most of the grids of the gun have circular beam passing holes, mandrels P are also formed in circular section. And the diameter of each mandrel is stepwisely reduced toward its end, as diameters of beam passing holes become smaller, closer to the cathode.

Meanwhile, grids E1', E2' for forming a quadrupole lens, have vertically or horizontally elongated holes Hv, Hh, and cannot be secured to mandrels P of circular sections. As depicted in FIG. 2, the upper grid E1' having vertically elongated holes Hv moves up and down, and the lower grid E2' having horizontally elongated holes Hh moves right and left, thereby injuring the alignment of the assembled gun. The misalignment of the gun not only deteriorates the color purity and the resolution, but also distorts the electrostatic lens. To prevent this problem, an additional precise assembly hole and guide pin, or an external guiding means are needed.

SUMMARY OF THE INVENTION

It is therefore an object of the present invention to provide an electron gun for a color picture tube, capable of forming a quadrupole lens while maintaining the alignment.

It is another object of the present invention to provide a gun which can be easily produced.

To achieve the primary object of the present invention, there is provided an electron gun for a color picture tube, having at least one quadrupole lens formed between a couple of adjacent grids on which three electron beam passing holes are respectively arranged in line, characterized in that:

one grid of two adjacent grids, comprises a circular central hole and two elongated side holes, and the other grid comprises an elongated central hole and two circular side holes.

Two different voltages are respectively applied to each of these two adjacent grids. When the quadrupole lens formed therebetween has a positive astigmatism, if the central hole of the high potential grid is formed in a vertically elongated hole, the two side holes are formed in circular holes, and the central and two side holes of the opposite low potential grid are formed in a circular hole and horizontally elongated holes, respectively. On the contrary, if the central hole of the high potential grid is formed in a circular hole, the two side holes are formed in vertically elongated holes, and the central and two side holes of the low potential grid are formed in a horizontally elongated hole and circular holes, respectively. For the two structures described above, it is well known that the sign of astigmatism can be reversed by simply reversing the high and low potentials.

To achieve the secondary object of the present invention, the elongated hole for use in the present invention, is preferably formed in the shape of a segmented circle. And the centers of two side holes are offset by a prescribed distance, instead of forming flanges at the circumference of the beam passing holes.

BRIEF DESCRIPTION OF THE DRAWINGS

These and other objects and advantages of the present invention will be more apparent from the following detailed description with reference to the accompanying drawings, wherein.

DETAILED DESCRIPTION OF THE INVENTION

Figure 3:
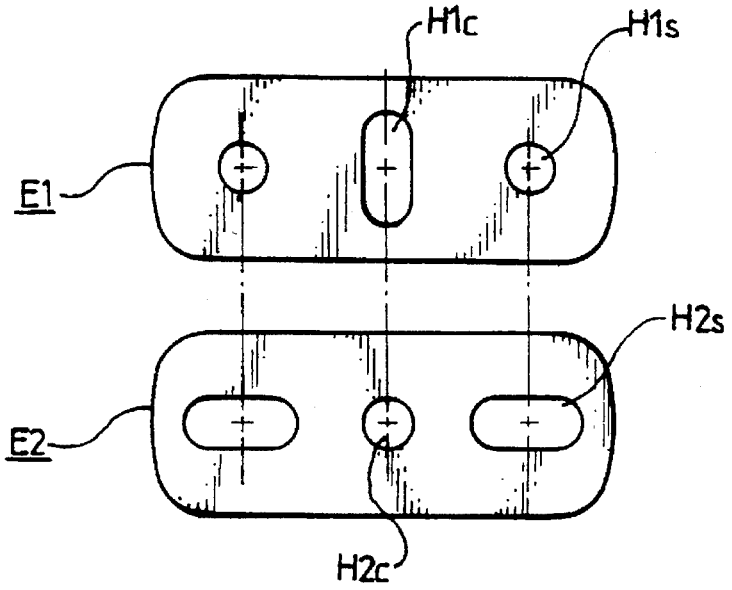
FIG. 3 is a plan view showing two adjacent grids for forming a quadrupole lens according to the present invention.

Referring to FIG. 3, in an electron gun for a color picture tube according to the present invention, electron beam passing holes H1*c*, H1*s*, H2*c*, H2*s* of two adjacent grids E1, E2 are formed in characteristic shapes to form a quadrupole lens.

As will be shown in FIG. 3, shapes of holes H1*c*, H1*s*, H2*c*, H2*s* of each grid E1 or E2, are different in central holes H1*c*, H2*c* and two side holes H1*s*, H2*s*, and in corresponding holes H2*c*, H2*s*, H1*c*, H1*s* of the opposite grid E2 or E1. In other words, central hole H1*c* and two side holes H1*s* can be selected between circular and elongated holes, but in an alternative or exclusive manner, and the exclusive relation is also established against corresponding holes H2*c*, H2*s* of the opposite grid E2.

Assuming that the upper grid E1 is to be a high potential grid, to which a high voltage is being applied, the lower grid E2 to be a low potential grid, and a quadrupole lens of a positive astigmatism to be formed between two grids E1, E2, if the central hole H1*c* of the high potential grid E1 is formed as a vertically elongated hole, the two side holes H1*s* are formed in circular holes. In the opposite low potential grid E2, central hole H2*c* is formed in circular hole, and two side holes H2*s* in horizontally elongated holes.

According to the above described structure, the central beam for passing central holes H1*c*, H2*c* attains a positive astigmatism by the quadrupole lens formed between the vertically elongated hole H1*c* of the high potential grid E1 and the circular hole H2*c* of the low potential grid E2. Each of side beams respectively passing two side holes H1*s*, H2*s* also attains a positive astigmatism by the quadrupole lens formed between the circular hole H1*s* of the high potential grid E1 and the horizontally elongated hole H2*s* of low potential grid.

When the central hole H1*c* of the high potential grid E1 is formed in a circular hole, and the two side holes H1*s* are formed in vertically elongated holes, the central hole H2*c* and two side holes H2*s* of the low potential grid E2 are formed in a horizontally elongated hole and circular holes, respectively.

When a quadrupole lens of a negative astigmatism is formed between two grids E1, E2, the above descriptions will be reversed.

As described above, in the electron gun for a color picture tube according to the present invention, a quadrupole lens having a positive astigmatism is formed between two grids E1, E2 by providing a vertically elongated hole H1*c* in the high potential grid E1 or horizontally elongated holes H2*s* in the low potential grid E2, and circular holes H2*c*, H1*s* in opposite grids. The intensity of the quadrupole lens formed by the present invention, corresponds to about half of that of the conventional one described through FIG. 1.

Figure 4:
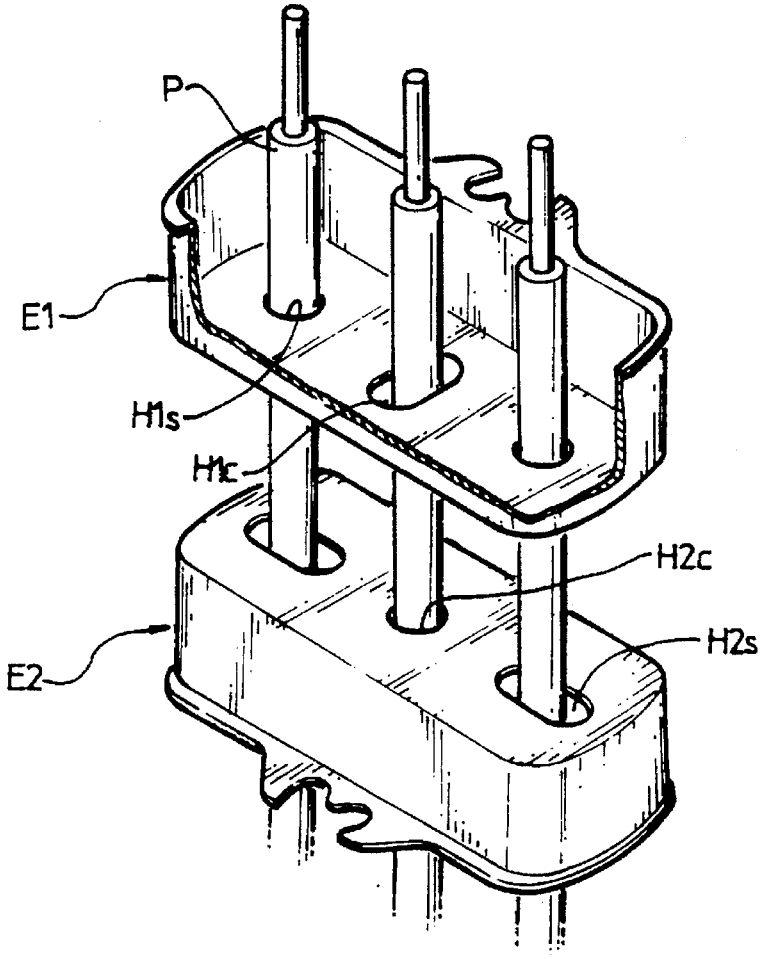
FIG. 4 is a perspective view illustrating the insertion of grids shown in FIG. 3 on mandrels.

According to the present invention, the alignment of the gun assembly is drastically improved. When grids E1, E2 are assembled by bead glasses, each grid E1, E2 is temporarily secured to mandrels P of a jig with beam passing holes H1*c*, H1*s*, H2*c*, H2*s* thereof being inserted as shown in FIG. 4. Among holes H1*c*, H1*s*, H2*c*, H2*s* of two grids E1, E2, circular holes H1*s*, H2*c* and vertically or horizontally elongated holes H1*c*, H2*s* are mixed, and grids E1, E2 can be supported on mandrels P without any play therebetween. The gun can accordingly be assembled in good alignment without any additional guide means.

Now referring to FIG. 5A to FIG. 5E, there are exemplified various shapes of holes H for use in elongated beam passing holes of the present invention.

Figure 5A:
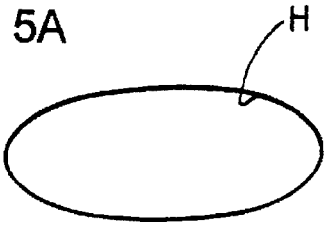
FIG. 5A to FIG. 5E are plan views respectively showing shapes of electron beam passing holes for use in the present invention.
Figure 5B:
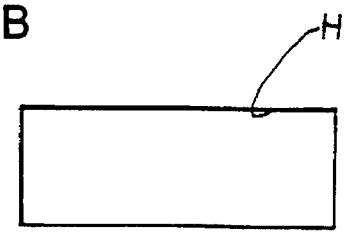
Figure 5C:
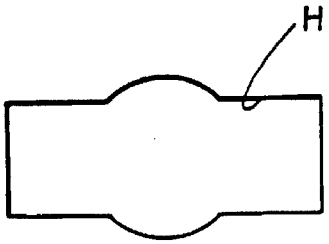
Figure 5D:
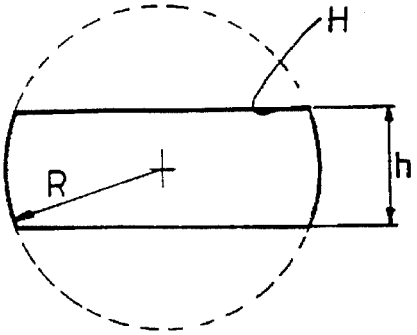
Figure 5E:
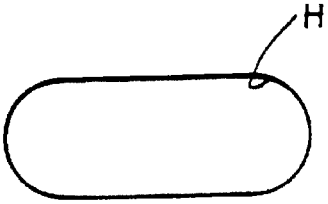

Here, FIG. 5A depicts an oval type hole, FIG. 5B rectangular, FIG. 5C keyhole, FIG. 5D segmented circle, and FIG. 5E rounded end.

The following <Table 1> summarizes characteristics of each elongated hole H when it is used for the electron beam passing hole.

TABLE 1

| TYPE | MANUFACTURE | ALIGNMENT | OPTICS |
|---|---|---|---|
| Oval | Difficult | one-direction | Best |
| Rectangular | Easy | one-direction | Worst |
| Keyhole | Difficult | two-direction | Good |
| Segmented circle | Easy | one-direction | Good |
| Rounded end | Easy | one-direction | Good |

In the table, the alignment means the restricted direction of movement of the hole being inserted on the mandrel P, and all the holes, except the keyhole type hole, have one-directional alignment.

Grids E1, E2 are manufactured by blanking and deep-drawing the metal sheet, and punching it to form the hole H to be the beam passing hole. Considering the manufacturing process, the rectangular hole can be most easily fabricated, but the focusing characteristics (optics) is not good. Meanwhile, the oval hole reveals the best optics but the manufacture is not easy. And the keyhole type hole achieves the best alignment, but cannot be made easily, too.

Therefore, the shape of the beam passing hole for use in the construction of the gun according to the present invention, is preferably to be the segmented circle as shown in FIG. 5D. The segmented circle has the shape taken from a circle of a certain radius R along with its diameter by a prescribed breadth h.

The rounded end hole shown in FIG. 5E, which is formed by rounding off both ends of a rectangular hole, can be adopted for the present invention together with the segmented circle type hole.

At the edge of the beam passing holes, a flange can be fabricated to control the electric field by blocking the side wall effect or others. Compared to the rectangular or circular hole, the fabrication of the flange is much more difficult on the oval, segmented circle or the rounded end type hole.

Therefore, the present invention preferably offsets centers of two side holes by a prescribed distance, instead of the fabrication of the flange, to block the side wall effect or others.

Figure 6:
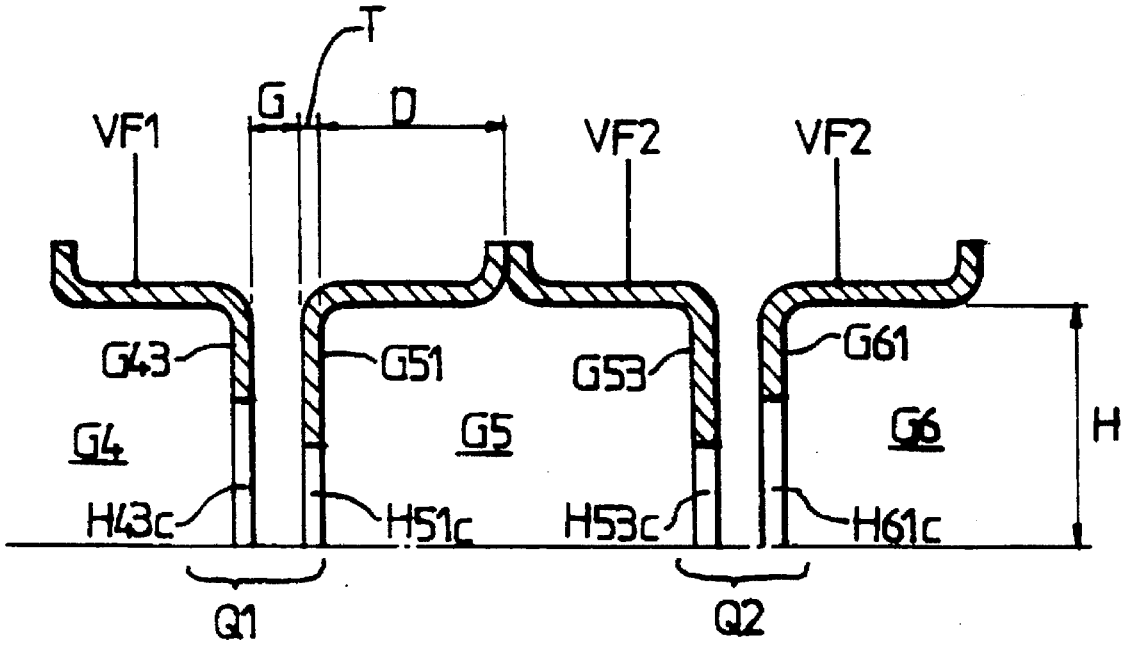
FIG. 6 is a partially taken sectional view depicting an electron gun constructed according to the present invention.
Figure 7:
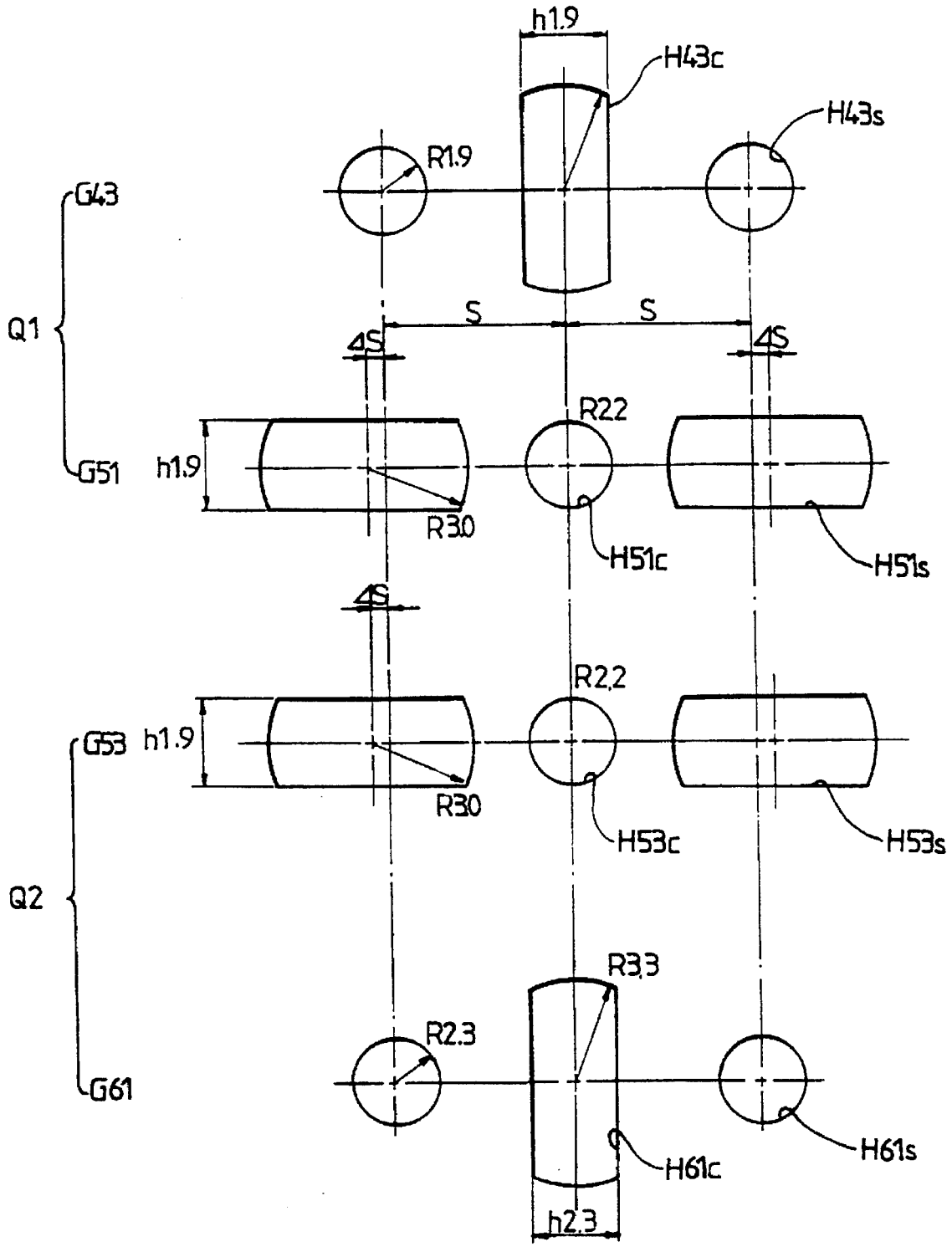
FIG. 7 is a projected plan view exemplifying the arrangement and dimensions of beam passing holes of grids shown in FIG. 6.

Referring to FIGS. 6 and 7, there is shown an actually designed example of the electron gun according to the present invention.

Figure 1:
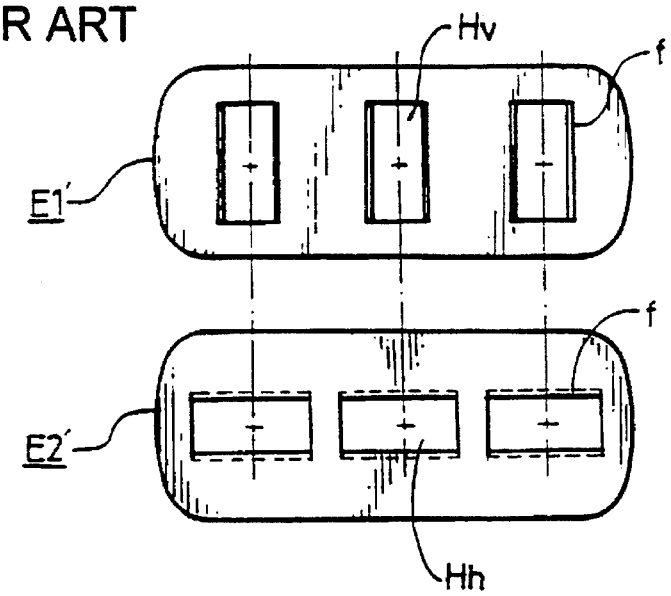
FIG. 1 PRIOR ART
FIG. 1 is a plan view for showing two conventional adjacent grids for forming a quadrupole lens.
Figure 2:
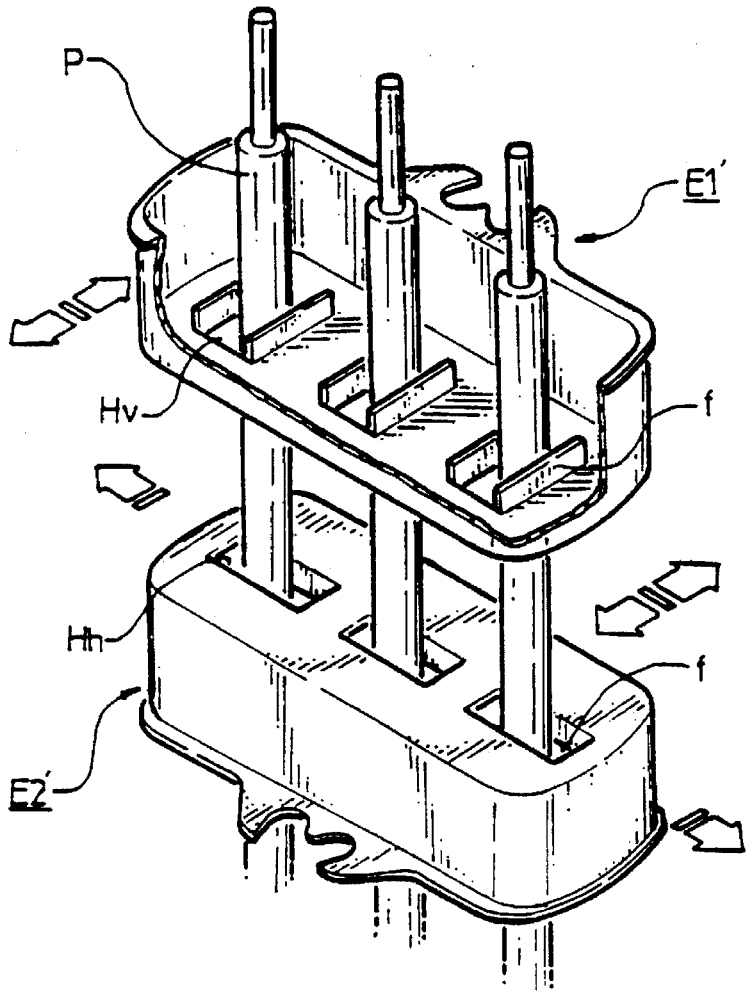
FIG. 2 PRIOR ART
FIG. 2 is a perspective view depicting the insertion of grids of FIG. 1 on mandrels.

In FIGS. 6 and 7, grid parts G43, G51, G53 and G61 consist of cup type grid parts. Two quadrupole lenses Q1, Q2 are respectively formed between the exit plate G43 of the G4 grid and the incident plate G51 of the G5 grid, and between the exit plate G53 of the G5 grid and incident plate G61 of the G6 grid. The formation of two quadrupole lenses Q1, Q2 is for compensating the fact that the intensities of quadrupole lenses Q1, Q2 of the present invention correspond to half of that of conventional one as shown in FIG. 1.

Prescribed focusing voltages VF1, VF2 are respectively applied to each of grids G4, G5 and G6. A voltage VF1 of 6600 V, for example, is commonly applied to the G4 and G6 grids, and another voltage VF2 of 7800 V is applied to the G5 grid. Thus, G5 grid is to be the high potential grid, and the G4 and G6 grids are to be low potential grids.

Numerals described in the drawings are in 'mm' units, R designates the radius of circular beam passing holes H43*s*, H51*c*, H53*c*, H61*s* and the radius of the segmented circle type hole H43*c*, H51*s*, H53*s*, H61*c*, namely the radius of its basic circle. Symbol h designates the breadth of segmented circle type hole H43*c*, H51*s*, H53*s*, H61*c*.

Remaining dimensions, not described in the drawings, are as follows in 'mm':

| | |
|---|---|
| Gap between grids | G: 0.8 |
| Thickness of grid | T: 0.4 |
| Grid length | D: 4.2 |
| Grid height | H: 5.4 |
| Beam spacing | S: 6.6 |

Here, the beam spacing S designates the spacing between central axis of electron beams respectively passing three beam passing holes, and is also referred to as the gun axis spacing.

In the drawing, the central axis of side holes H51*s*, H53*c* formed on the incident and exit plates G51, G53 of the G5 grid, are outwardly offset from the side axes of the gun assembly by a prescribed distance ΔS, for example 0.3 mm, to block the sidewall effect.

According to the present invention, there is provided an electron gun having quadrupole lenses for effectively compensating astigmatism with assuring an easy fabrication and assembly, and a precise alignment.

We claim:

1. An electron gun for a color picture tube comprising:

two adjacent grids on which three electron beam passing holes are respectively arranged in line; and, at least one quadrupole lens formed between said two adjacent grids; wherein a first grid of said two adjacent grids comprises a circular central hole and two elongated side holes and a second grid of said two adjacent grids comprises an elongated central hole and two circular side holes.

2. The electron gun as claimed in claim 1, wherein different voltages are respectively applied to each of said two adjacent grids to divide them into a high potential grid and a low potential grid.

3. The electron gun as claimed in claim 2, wherein when said central hole of said first grid is a vertically elongated hole, said two side holes are to be circular holes, and said central hole and two side holes of said second grid are respectively to be a circular hole and horizontally elongated holes.

4. The electron gun as claimed claim 2, wherein when said central hole of said first grid is a circular hole, said two side holes are to be vertically elongated hole, and said central hole and two side holes of said second grid are respectively to be a horizontally elongated hole and circular holes.

5. The electron gun as claimed in claim 1, wherein said quadrupole lens formed between said two adjacent grids has astigmatism opposite to that of the main lens or deflection field astigmatism.

6. The electron gun as claimed in claim 5, wherein when said central hole of said first grid is a vertically elongated hole, said two side holes are to be circular holes, and said central hole and two side holes of said second grid are respectively to be a circular hole and horizontally elongated holes.

7. The electron gun as claimed claim 5, wherein when said central hole of said first grid is a circular hole, said two side holes are to be vertically elongated holes, and said central hole and two side holes of said second grid are respectively to be a horizontally elongated hole and circular holes.

8. The electron gun as claimed in claim 1, wherein said elongated hole is formed as an oval, rectangular or keyhole type hole.

9. The electron gun as claimed in claim 1, wherein said elongated hole is formed in the shape of a segmented circle type hole fabricated by taking an interior segment of prescribed breadth, or a rounded end type hole fabricated by rounding off either ends of a rectangular hole.

10. The electron gun as claimed in claim 1, wherein centers of two side holes are offset by a prescribed distance from the side axes of said gun.

* * * * *